US012565819B2

(12) United States Patent
Romer et al.

(10) Patent No.: US 12,565,819 B2
(45) Date of Patent: Mar. 3, 2026

(54) ELECTRIC SUBMERSIBLE PUMP (ESP) SEAL UNIT

(71) Applicant: ExxonMobil Technology and Engineering Company, Spring, TX (US)

(72) Inventors: Michael C. Romer, Tomball, TX (US); Derek B. Bush, The Woodlands, TX (US)

(73) Assignee: ExxonMobil Technology and Engineering Company, Spring, TX (US)

( * ) Notice: Subject to any disclaimer, the term of this patent is extended or adjusted under 35 U.S.C. 154(b) by 37 days.

(21) Appl. No.: 18/604,755

(22) Filed: Mar. 14, 2024

(65) Prior Publication Data

US 2024/0337169 A1 Oct. 10, 2024

Related U.S. Application Data

(60) Provisional application No. 63/494,341, filed on Apr. 5, 2023.

(51) Int. Cl.
*E21B 33/12* (2006.01)
*E21B 43/10* (2006.01)
*E21B 43/12* (2006.01)

(52) U.S. Cl.
CPC ..... *E21B 33/1208* (2013.01); *E21B 43/105* (2013.01); *E21B 43/128* (2013.01)

(58) Field of Classification Search
CPC ... E21B 33/1208; E21B 43/105; E21B 43/128
See application file for complete search history.

(56) References Cited

U.S. PATENT DOCUMENTS 3,916,685 A 11/1975 Paap et al.
5,959,431 A 9/1999 Xiang
(Continued)

FOREIGN PATENT DOCUMENTS

CN 110837045 A1 2/2020
EP 2077374 A1 7/2009
(Continued)

OTHER PUBLICATIONS

Fluke Corporation, Fluke 430 Series II, Three-Phase Power Quality and Energy Analyzers, 2012, 11 pages.
(Continued)

*Primary Examiner* — Hoang M Nguyen
(74) *Attorney, Agent, or Firm* — Troutman Pepper Locke LLP

(57) ABSTRACT

An electric submersible pump (ESP) system is described herein. The ESP system includes a pump and a motor connected to drive the pump. The pump and motor are disposed to pump fluid into production tubing in a wellbore. The motor produces heat when operating. The wellbore contains wellbore fluids. A seal unit is connected between the motor and the pump. The seal unit contains oil to lubricate the motor. Further, the seal unit receives heat from the motor when the motor is running. The seal unit contains a structure to reduce loss of heat after the motor stops running to reduce an exchange of oil from the seal unit to the wellbore and to reduce an exchange of wellbore fluids from the wellbore to the seal unit.

25 Claims, 5 Drawing Sheets

(56) References Cited

U.S. PATENT DOCUMENTS

| | | | | |
|---|---|---|---|---|
| 6,328,102 | B1 | 12/2001 | Dean | |
| 7,111,675 | B2 | 9/2006 | Zisk, Jr. | |
| 7,322,803 | B2 | 1/2008 | Vogeley | |
| 7,484,940 | B2 | 2/2009 | O'Neill | |
| 7,597,150 | B2 | 10/2009 | Clem | |
| 7,832,503 | B2 | 11/2010 | Sand et al. | |
| 8,133,041 | B2 | 3/2012 | Ludlow et al. | |
| 8,220,533 | B2 | 7/2012 | Longfield et al. | |
| 8,322,434 | B2 | 12/2012 | Fielding et al. | |
| 8,511,390 | B2 | 8/2013 | Coyle et al. | |
| 9,121,270 | B2 | 9/2015 | Seitter | |
| 9,388,812 | B2 | 7/2016 | Fastovets et al. | |
| 10,132,143 | B2 | 11/2018 | Romer et al. | |
| 10,480,297 | B2 | 11/2019 | Chidi et al. | |
| 11,365,613 | B2 | 6/2022 | Romer et al. | |
| 11,555,396 | B2 | 1/2023 | Romer et al. | |
| 2002/0197174 | A1 | 12/2002 | Howard | |
| 2003/0010491 | A1 | 1/2003 | Collette | |
| 2004/0134654 | A1 | 7/2004 | Snow | |
| 2006/0196655 | A1* | 9/2006 | Wang | F04D 13/10 166/105.3 |
| 2006/0198742 | A1 | 9/2006 | DiFoggio et al. | |
| 2007/0224056 | A1* | 9/2007 | Watson | E21B 43/128 310/87 |
| 2008/0080991 | A1 | 4/2008 | Yuratich et al. | |
| 2009/0211763 | A1 | 8/2009 | Fowler et al. | |
| 2009/0218091 | A1 | 9/2009 | Dotson | |
| 2010/0012313 | A1 | 1/2010 | Longfield et al. | |
| 2012/0263606 | A1 | 10/2012 | Bouldin et al. | |
| 2012/0319474 | A1* | 12/2012 | Chung | H02J 3/1892 307/17 |
| 2014/0343743 | A1 | 11/2014 | DaCunha et al. | |
| 2017/0089192 | A1 | 3/2017 | Rendusara et al. | |
| 2018/0183377 | A1 | 6/2018 | McMullen | |
| 2019/0044421 | A1 | 2/2019 | Grande et al. | |
| 2019/0204467 | A1 | 7/2019 | Curt et al. | |
| 2019/0393816 | A1 | 12/2019 | Chedygov et al. | |
| 2020/0182029 | A1* | 6/2020 | Romer | E21B 47/008 |
| 2024/0192037 | A1* | 6/2024 | Sheth | E21B 21/08 |

FOREIGN PATENT DOCUMENTS

| | | | |
|---|---|---|---|
| GB | 2393747 | A | 4/2004 |
| GB | 2403752 | A | 1/2005 |
| WO | 1992015148 | A1 | 9/1992 |
| WO | 2001020126 | A1 | 3/2001 |
| WO | 2009077714 | A1 | 6/2009 |
| WO | 2011079218 | A1 | 6/2011 |
| WO | 2019195520 | A1 | 10/2019 |

OTHER PUBLICATIONS

IEEE Standards Association, IEE Recommended Practice and Requirements for Harmonic Control in Electric Power Systems, IEEE Power and Energy Society, Sponsored by the Transmission and Distribution Committee, 2014, p. 29 pages.

Baker Hughes a GE Company, Zenith E-Series ESP Gauages, Prolong ESP Run Life And Enhance Oil Recovery, 2018, 2 pages.

Baker Hughes, Artificial Lift Sensors, Well Lift H Downhole Sensor, 2010, 12 pages.

* cited by examiner

400

500

ELECTRIC SUBMERSIBLE PUMP (ESP) SEAL UNIT

CROSS-REFERENCE TO RELATED APPLICATION

This application claims priority to and the benefit of U.S. Provisional Application No. 63/494,341, entitled "ELECTRIC SUBMERSIBLE PUMP (ESP) SEAL UNIT," having a filing date of Apr. 5, 2023, the disclosure of which is incorporated herein by reference in its entirety.

FIELD OF THE INVENTION

The techniques described herein relate to the field of artificial lift technology for wells, including hydrocarbon wells or water wells. More particularly, the techniques described herein relate to electric submersible pumps (ESPs).

BACKGROUND

This section is intended to introduce various aspects of the art, which may be associated with embodiments of the present techniques. This discussion is believed to assist in providing a framework to facilitate a better understanding of particular aspects of the present techniques. Accordingly, it should be understood that this section should be read in this light, and not necessarily as admissions of prior art.

Artificial lift includes a number of methods for transporting produced hydrocarbon fluids within a wellbore to the surface when reservoir pressure alone is not sufficient. While many hydrocarbon wells initially have sufficient reservoir pressure to force hydrocarbon fluids from the reservoir to the surface, the reservoir pressure declines as production continues. As a result, more than 60% of hydrocarbon wells require the use of one or more artificial lift methods to boost production.

One common artificial lift method involves using electric submersible pump (ESP) systems to lift hydrocarbon fluids to the surface. More than 15% of hydrocarbon wells worldwide utilize some form of ESP system to aid with production. In fact, ESP systems are the fastest-growing form of artificial lift pumping technology. ESP systems are very versatile and are capable of operating in high-volume and/or very deep environments. For example, a typical ESP system can handle flow rates in excess of 30,000 barrels per day (bpd) and can provide more than 15,000 feet of lift.

ESP systems typically have a large number of components and can be 100+ ft. in length. Typical ESP sections include an electric motor, a seal unit (also known as a protector), an intake, centrifugal pumping stages, a discharge, and may include optional components such as a gas separator, a solids separator, and/or a downhole sensor.

The ESP motor is typically a three-phase AC induction motor but can also be a permanent magnet motor. The motor is powered via a cable that extends to the surface and through the wellhead. The motor spins a shaft which rotates the centrifugal pump stages, increasing the pressure of the pumped fluids so they can be produced at the surface. The seal/protector section handles the thermal expansion of the motor's oil, allows the motor internals to equalize pressure with the well environment, and may carry a substantial portion of the ESP's thrust load.

ESP systems have relatively short run lives. Specifically, an average ESP system has a run life of two to three years, with a run life in excess of five years being uncommon. The run life of an ESP system is generally determined by the environment in which it operates, as well as by the manner in which it is operated. Moreover, because ESP systems are typically attached to production tubing and installed with a rig, ESP installation and replacement workovers can be relatively expensive. This is particularly true in offshore and remote locations, which often make ESP installations and retrievals economically prohibitive.

One of the functions of the ESP seal section is to accommodate the expansion/contraction of dielectric oil. As the ESP motor begins to operate, its internal temperature rises and the dielectric oil filling the motor expands. The motor and seal section share the same oil reservoir, so the motor oil expansion results in displacement of oil in the seal. The seal section may be designed to allow the expanded oil to escape into the wellbore to avoid damage from the increased pressure in the seal system and motor. As a result of the expansion of the oil, some wellbore fluids may enter the seal section to replace the lost oil when the ESP is shut off, the motor and seal cool, and the internal dielectric oil contracts.

The seal section internals may be designed to employ one or more labyrinth chambers to create a tortuous path between the entry point and ESP motor to prevent contaminated fluids from reaching and shorting out the electrical system. Alternatively, or in connection with a labyrinth chamber, an expandable bag or metal bellows may be used to provide space for expansion of dielectric oil from a heated ESP system motor. Over time, the dielectric oil may become mixed with wellbore fluids as the ESP system is subjected to multiple start/stop cycles. Excessive losses of internal fluids can also lead to the failure of partially filled expandable bags because of thermal cycling and external-internal pressure differentials. Examples of failures of the bag include tears or ruptures, either of which would release the fluid within the bag to mix with wellbore fluids that have entered the seal section. The contaminated dielectric oil may then come into contact with electrical components of the ESP system.

In short, ESP thermal cycling and resulting dielectric/wellbore fluid exchange may eventually cause a seal section to fail, causing damage to the ESP system motor and other components. Such failure may result in expensive repair efforts, including removing the entire ESP system with a rig for repairs. A system and method of improving ESP seal section performance is therefore desirable.

SUMMARY

An embodiment described herein provides an electric submersible pump (ESP) system. The ESP system includes a pump and a motor connected to drive the pump. The pump and motor are disposed to pump fluid into production tubing in a wellbore containing wellbore fluids. The motor produces heat when operating. The embodiment includes a seal unit connected between the motor and the pump. The seal unit contains oil to lubricate the motor. The seal unit receives heat from the motor when the motor is running. The seal unit further contains a structure to reduce loss of heat after the motor stops running to reduce an exchange of oil from the seal unit to the wellbore and to reduce an exchange of wellbore fluids from the wellbore to the seal unit.

Another embodiment described herein provides a method of operating an electric submersible pump (ESP) system. The method includes disposing a motor and a pump, the motor being connected to drive the pump, to pump fluid into production tubing in a wellbore. The wellbore contains wellbore fluids. The motor produces heat when operating. The method also includes connecting a seal unit between the motor and the pump. The seal unit contains oil to lubricate the motor. The seal unit receives heat from the motor when the motor is running. The seal unit further contains a structure to reduce loss of heat after the motor stops running to reduce an exchange of oil from the seal unit to the wellbore and to reduce an exchange of wellbore fluids from the wellbore to the seal unit.

A further embodiment described herein provides a well. The well includes an electric submersible pump (ESP) system that includes a pump and a motor connected to drive the pump. The pump and motor are disposed to pump fluid into production tubing in a wellbore. The wellbore contains wellbore fluids. The motor produces heat when operating. A seal unit is connected between the motor and the pump. The seal unit contains oil to lubricate the motor. The seal unit receives heat from the motor when the motor is running. The seal unit further contains a structure to reduce loss of heat after the motor stops running to reduce an exchange of oil from the seal unit to the wellbore and to reduce an exchange of wellbore fluids from the wellbore to the seal unit.

These and other features and attributes of the disclosed embodiments of the present techniques and their advantageous applications and/or uses will be apparent from the detailed description that follows.

BRIEF DESCRIPTION OF THE DRAWINGS

The foregoing and other advantages of the present techniques may become apparent upon reviewing the following detailed description and drawings of non-limiting examples in which.

Figure 1:
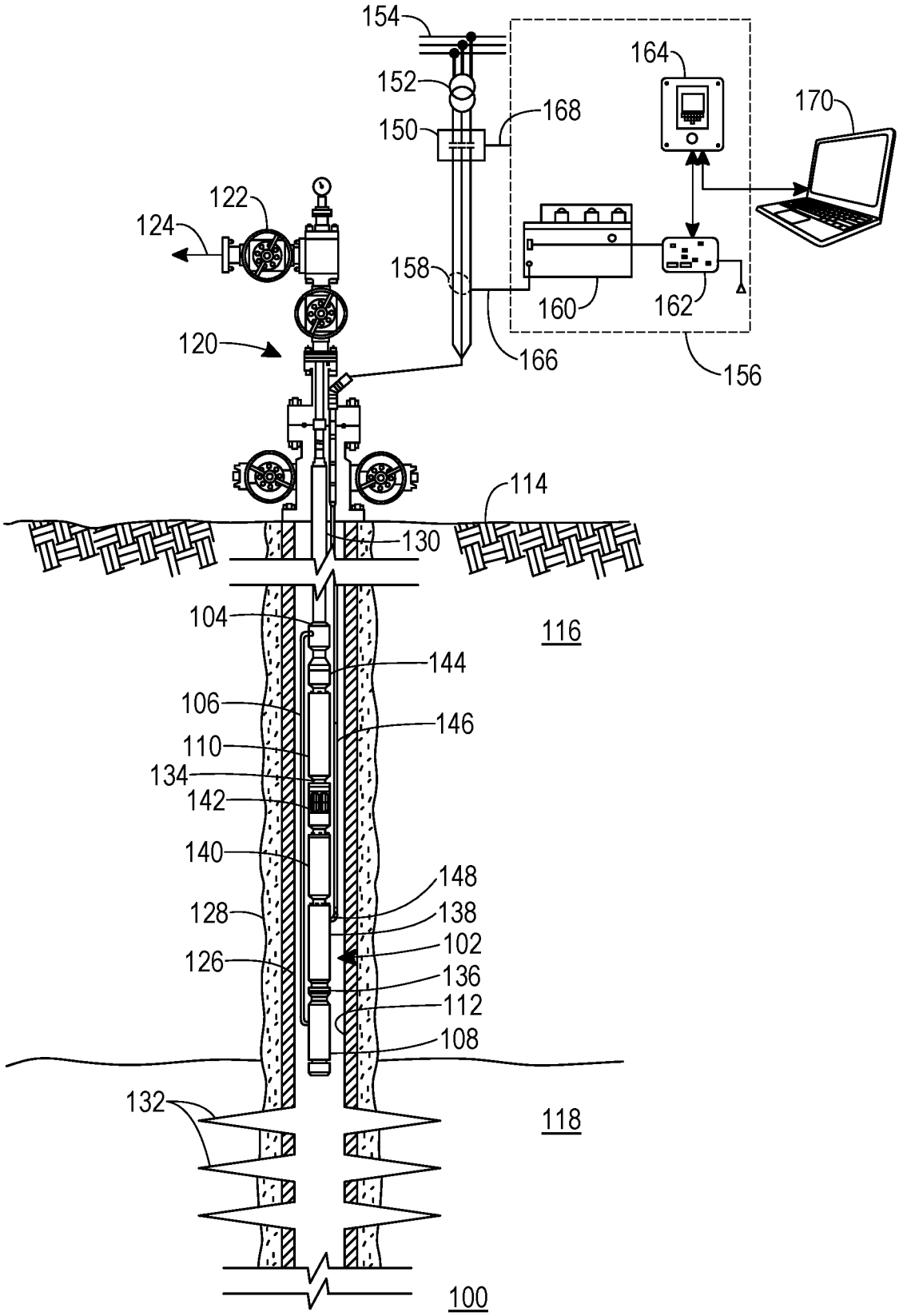
FIG. 1 [PRIOR ART]
FIG. 1 is a cross-sectional schematic view of a hydrocarbon well including an electric submersible pump (ESP) system.

It should be noted that the figures are merely examples of the present techniques, and no limitations on the scope of the present techniques are intended thereby. Further, the figures are generally not drawn to scale, but are drafted for purposes of convenience and clarity in illustrating various aspects of the techniques.

DETAILED DESCRIPTION

In the following detailed description section, the specific examples of the present techniques are described in connection with preferred embodiments. However, to the extent that the following description is specific to a particular embodiment or a particular use of the present techniques, this is intended to be for example purposes only and simply provides a description of the embodiments. Accordingly, the techniques are not limited to the specific embodiments described below, but rather, include all alternatives, modifications, and equivalents falling within the true spirit and scope of the appended claims.

At the outset, and for ease of reference, certain terms used in this application and their meanings as used in this context are set forth. To the extent a term used herein is not defined below, it should be given the broadest definition persons in the pertinent art have given that term as reflected in at least one printed publication or issued patent. Further, the present techniques are not limited by the usage of the terms shown below, as all equivalents, synonyms, new developments, and terms or techniques that serve the same or a similar purpose are considered to be within the scope of the present claims.

As used herein, the terms "a" and "an" mean one or more when applied to any embodiment described herein. The use of "a" and "an" does not limit the meaning to a single feature unless such a limit is specifically stated.

The term "and/or" placed between a first entity and a second entity means one of (1) the first entity, (2) the second entity, and (3) the first entity and the second entity. Multiple entities listed with "and/or" should be construed in the same manner, i.e., "one or more" of the entities so conjoined. Other entities may optionally be present other than the entities specifically identified by the "and/or" clause, whether related or unrelated to those entities specifically identified. Thus, as a non-limiting example, a reference to "A and/or B," when used in conjunction with open-ended language such as "including," may refer, in one embodiment, to A only (optionally including entities other than B); in another embodiment, to B only (optionally including entities other than A); in yet another embodiment, to both A and B (optionally including other entities). These entities may refer to elements, actions, structures, steps, operations, values, and the like.

The phrase "at least one," in reference to a list of one or more entities, should be understood to mean at least one entity selected from any one or more of the entities in the list of entities, but not necessarily including at least one of each and every entity specifically listed within the list of entities, and not excluding any combinations of entities in the list of entities. This definition also allows that entities may optionally be present other than the entities specifically identified within the list of entities to which the phrase "at least one" refers, whether related or unrelated to those entities specifically identified. Thus, as a non-limiting example, "at least one of A and B" (or, equivalently, "at least one of A or B," or, equivalently, "at least one of A and/or B") may refer, in one embodiment, to at least one, optionally including more than one, A, with no B present (and optionally including entities other than B); in another embodiment, to at least one, optionally including more than one, B, with no A present (and optionally including entities other than A); in yet another embodiment, to at least one, optionally including more than one, A, and at least one, optionally including more than one, B (and optionally including other entities). In other words, the phrases "at least one," "one or more," and "and/or" are open-ended expressions that are both conjunctive and disjunctive in operation. For example, each of the expressions "at least one of A, B, and C," "at least one of A, B, or C," "one or more of A, B, and C," "one or more of A, B, or C," and "A, B, and/or C" may mean A alone, B alone, C alone, A and B together, A and C together, B and C together, A, B, and C together, and optionally any of the above in combination with at least one other entity.

As used herein, the term "configured" mean that the element, component, or other subject matter is designed and/or intended to perform a given function. Thus, the use of the term "configured" should not be construed to mean that a given element, component, or other subject matter is simply "capable of" performing a given function but that the element, component, and/or other subject matter is specifically selected, created, implemented, utilized, and/or designed for the purpose of performing the function.

As used herein, the terms "example," exemplary," and "embodiment," when used with reference to one or more components, features, structures, or methods according to the present techniques, are intended to convey that the described component, feature, structure, or method is an illustrative, non-exclusive example of components, features, structures, or methods according to the present techniques. Thus, the described component, feature, structure or method is not intended to be limiting, required, or exclusive/exhaustive; and other components, features, structures, or methods, including structurally and/or functionally similar and/or equivalent components, features, structures, or methods, are also within the scope of the present techniques.

As used herein, the term "fluid" refers to gases, liquids, and combinations of gases and liquids, as well as to combinations of gases and solids, and combinations of liquids and solids.

"Formation" refers to a subsurface region including an aggregation of subsurface sedimentary, metamorphic and/or igneous matter, whether consolidated or unconsolidated, and other subsurface matter, whether in a solid, semi-solid, liquid and/or gaseous state, related to the geological development of the subsurface region. A formation can be a body of geologic strata of predominantly one type of rock or a combination of types of rock, or a fraction of strata having substantially common sets of characteristics. A formation can contain one or more hydrocarbon-bearing subterranean formations. Note that the terms "formation," "reservoir," and "interval" may be used interchangeably, but may generally be used to denote progressively smaller subsurface regions, zones, or volumes. More specifically, a "formation" may generally be the largest subsurface region, while a "reservoir" may generally be a hydrocarbon-bearing zone or interval within the geologic formation that includes a relatively high percentage of oil and gas. Moreover, an "interval" may generally be a sub-region or portion of a reservoir. In some cases, a hydrocarbon-bearing zone, or reservoir, may be separated from other hydrocarbon-bearing zones by zones of lower permeability, such as mudstones, shales, or shale-like (i.e., highly-compacted) sands.

A "hydrocarbon" is an organic compound that primarily includes the elements hydrogen and carbon, although nitrogen, sulfur, oxygen, metals, or any number of other elements may be present in small amounts. As used herein, the term "hydrocarbon" generally refers to components found in natural gas, oil, or chemical processing facilities. Moreover, the term "hydrocarbon" may refer to components found in raw natural gas, such as $CH_4$, $C_2H_6$, $C_3$ isomers, $C_4$ isomers, benzene, and the like.

The term "pressure" refers to a force acting on a unit area. Pressure is usually shown as pounds per square inch (psi).

As used herein, the term "production tubing" refers to a wellbore tubular that is connected to an electric submersible pump (ESP) discharge and is used to produce hydrocarbon fluids from a reservoir.

As used herein, the term "surface" refers to the uppermost land surface of a land well, or the mud line of an offshore well, while the term "subsurface" (or "subterranean") generally refers to a geologic strata occurring below the earth's surface. Moreover, as used herein, "surface" and "subsurface" are relative terms. The fact that a particular piece of equipment is described as being on the surface does not necessarily mean it must be physically above the surface of the earth but, rather, describes only the relative placement of the surface and subsurface pieces of equipment. In that sense, the term "surface" may generally refer to any equipment that is located above the casing, production tubing, and other equipment that is located inside the wellbore. Moreover, according to embodiments described herein, the terms "downhole" and "subsurface" are sometimes used interchangeably, although the term "downhole" is generally used to refer specifically to the inside of the wellbore.

The term "wellbore" refers to a hole drilled vertically, at least in part, and may also refer to a hole drilled with deviated, highly deviated, and/or horizontal sections. The term "hydrocarbon well" includes the wellbore as well as the associated equipment, such as the wellhead, casing string(s), production tubing, and the like.

Overview

Embodiments described herein provide an electric submersible pump (ESP) system. ESP systems have many uses, including assisting in the production of hydrocarbons and drawing water from aquifers. An ESP system according to the present techniques may provide improved component reliability relative to known ESP systems, as explained herein.

FIG. 1 is a cross-sectional schematic view of a hydrocarbon well 100 including an electric submersible pump (ESP) system 102 with a pump discharge 104 and a hydraulic line 106 that enable a monitoring unit 108 to measure the discharge pressure of a pump 110. The hydrocarbon well 100 defines a wellbore 112 that extends from a surface 114 into a formation 116 within the earth's subsurface. The formation 116 may include several subsurface intervals, such as a hydrocarbon-bearing interval that is referred to herein as a reservoir 118.

The hydrocarbon well 100 also includes a wellhead 120. The wellhead 120 includes a number of pipes, valves, gauges, and other instrumentation for controlling the hydrocarbon well 100. For example, the wellhead 120 includes a wing valve 122 that controls the flow of hydrocarbon fluids from the wellbore 112, as indicated by arrow 124.

The hydrocarbon well 100 is completed by setting a series of tubulars, referred to as casing strings, into the formation 116. The simplified schematic of FIG. 1 depicts a hydrocarbon well 100 with a single casing string, which is referred to as the production casing string 126. However, it will be appreciated by one of skill in the art that the hydrocarbon well 100 may often include a number of different casing strings, such as a surface casing string, one or more intermediate casing strings, and the production casing string 126. Moreover, each casing string may be either hung from the surface 114 or from the bottom of the previous casing string using a liner hanger. As shown in FIG. 1, the production casing string 126 (as well as any surface and intermediate casing strings) is set in place using cement 128. The cement 128 isolates the intervals of the formation 116 from the hydrocarbon well 100 and each other. Alternatively, in some embodiments, the hydrocarbon well 100 may be set as an open-hole completion, meaning that the production casing string 126 is not set in place using cement.

The hydrocarbon well 100 includes production tubing 130 extending through the production casing string 126. In addition, the portion of the production casing string 126 extending into the reservoir 118 includes a number of perforations 132 that allow hydrocarbon fluids within the reservoir 118 to flow into the hydrocarbon well 100 and up the production tubing 130 to the surface 114. While the embodiment shown in FIG. 1 includes only one set of perforations 132, it will be appreciated by one of skill in the art that the hydrocarbon well 100 may include many separate stages extending through the reservoir 118, where each stage includes several sets of perforations. Moreover, while the simplified schematic view of FIG. 1 depicts the hydrocarbon well 100 as a vertical well, it will be appreciated by one of skill in the art that the hydrocarbon well 100 may include one or more lateral or deviated sections extending through the reservoir 118.

In many cases, the pressure within the reservoir 118 is initially high enough to force hydrocarbon fluids to the surface 114 without any assistance. However, as production continues, the reservoir pressure declines, causing the flow rate of the hydrocarbon fluids to decrease. Therefore, according to embodiments described herein, the hydrocarbon well 100 includes the electric submersible pump (ESP) system 102. The ESP system 102 provides artificial lift capabilities, boosting produced hydrocarbon fluids to the surface 114 when reservoir pressure alone is not sufficient. According to the embodiment shown in FIG. 1, the ESP system 102 is attached to, and installed with, the production tubing 130. However, in other embodiments, the ESP system 102 may be installed in any other suitable manner, such as via coiled tubing, for example.

In various embodiments, the ESP system 102 includes a number of components that are attached to a shaft 134. Specifically, the ESP system 102 includes the monitoring unit 108, a motor base crossover 136, a motor 138, a seal unit (or protector) 140, a pump intake 142, the pump 110, and a pump discharge 144. In operation, the produced hydrocarbon fluids enter the pump 110 via the pump intake 142. Because ESP systems have lower efficiencies in high gas/oil ratio (GOR) scenarios, the pump intake 142 may include a gas separator for removing free gas from the hydrocarbon fluids before the hydrocarbon fluids enter the pump 110. In some embodiments, the gas separator is a rotary gas separator that uses centrifugal force to separate the free gas from the liquids within the hydrocarbon fluids.

In various embodiments, the pump 110 is a multi-stage, centrifugal pump, where each stage within the pump 110 includes a rotating impeller and a stationary diffuser that sequentially increases the velocity and pressure of the hydrocarbon fluids flowing through the pump 110. In operation, the motor 138 spins the shaft 134, which rotates the impeller within each stage. This, in turn, increases the pressure of the pumped hydrocarbon fluids so that the hydrocarbon fluids can be produced to the surface 114. Because ESP systems are typically designed to fit in casing strings with limited inner diameters, the lift provided by each stage is relatively low. Therefore, many stages are stacked together within the pump housing to provide the desired amount of lift for the particular application.

In some embodiments, the motor 138 is a three-phase, squirrel-cage AC induction motor. In other embodiments, the motor 138 is a permanent magnet motor. The motor 138 is designed to work in high-temperature, high-pressure environments. The motor 138 may be filled with a dielectric oil that insulates closely-packed electrical components from one another and provides bearing lubrication, as well as a thermal pathway for dissipating heat generated by the motor windings.

The motor 138 is powered by an ESP power cable 146 that is connected to the motor 138 via a power cable connector 148, which may be referred to as a "pothead connector." The ESP power cable 146 is securely fixed to production tubing 130. The ESP power cable 146 extends through the wellbore 112 and through the wellhead 120 at the surface 114. In various embodiments, the ESP power cable 146 is an armored, three-phase electrical power cable, as described further herein. The ESP power cable 146 is connected to a switchboard or variable speed drive (VSD) 150, a transformer 152, and an electrical supply system 154, such as a commercial power distribution system, located at the surface 114.

The protector 140, which is also referred to as the "seal section" of the ESP system 102 protects the motor 138 from contamination by wellbore fluids. In addition, the protector 140 equalizes the pressure between the motor 138 and the wellbore 112, absorbs a substantial portion of the thrust load from the pump 110, and handles the thermal expansion of the oil within the motor 138.

The monitoring unit 108 is connected to the motor 138 via the motor base crossover 136. Specifically, the monitoring unit 108 is electrically connected to the motor wye point within the motor base crossover 136, which carries a secondary AC power signal to the monitoring unit 108. In various embodiments, the monitoring unit 108 includes DC power conversion circuitry that is configured to convert the AC power signal into a DC power signal that is suitable for powering the components of the monitoring unit 108. In this manner, the monitoring unit 108 is powered by a slipstream of the electricity that is being delivered to the motor 138 via the ESP power cable 146.

The monitoring unit 108 is configured to measure key parameters relating to the motor 138 and the pump intake 142, such as, for example, downhole vibration, motor oil temperature, motor winding temperature, intake pressure, intake temperature, water fraction, current leakage, wye voltage, and the like. These measurements are then communicated to an ESP surface unit 156 via the ESP power cable 146. Specifically, as indicated by dotted line 158, the sensor data are transmitted as a modulated signal that represents a serial digital data stream. In various embodiments, the modulated signal is generated by modulation circuitry, in cooperation with a microprocessor, within the monitoring unit 108. The modulated signal is then supplied to the motor wye point and is communicated over the conductors of the ESP power cable 146.

In various embodiments, the ESP surface unit 156 includes a surface choke 160, an ESP interface board 162, and a surface interface panel 164. As indicated by line 166, the surface choke 160 is used to isolate the motor voltage from the modulated signal before the modulated signal is received and interpreted by the ESP interface board 162. Specifically, the surface choke 160 includes demodulation circuitry that recovers the digital data stream from the modulated signal and supplies the recovered digital data stream to the ESP interface board 162. The ESP interface board 162 then interprets the digital data stream and (optionally) provides feedback relating to the data stream to the VSD 150, as indicated by dotted line 168. The VSD 150 may then use the feedback to determine the proper flow of electricity to the motor 138. In some embodiments, the interpreted data stream is also output to a surface interface panel 164, and then to the ESP operator via one or more remote devices, such as the laptop computer 170 shown in FIG. 1.

The ESP operator then uses the information provided by these measurements for ESP surveillance, troubleshooting, and optimization. For example, the ESP operator may use the information to proactively intervene when the performance of the ESP system is gradually declining or the ESP system encounters a sudden problem. In this manner, such information can be used to extend the run life of the ESP system, as well as boost production from the hydrocarbon well. In addition, in some cases, such information can provide helpful insight into the characteristics of the reservoir, which may be used to further improve production.

In some embodiments, the ESP operator may intervene by adjusting the frequency of the motor 138 or adjusting the voltage transmitted to the motor 138. Moreover, in some embodiments, the VSD 150 is configured to automatically adjust the frequency and/or voltage of the motor 138, or automatically shut down the motor 138, in response to receiving certain feedback from the ESP interface board 162. For example, if the feedback indicates that the value of a particular parameter exceeds a specific threshold, an electrical switch within the VSD 150 may automatically trip, shutting down the motor 138.

As explained herein, the seal unit 140 is designed to minimize the undesirable intrusion of well fluids caused by operation of the ESP system 102. The seal unit 140 may employ a variety of strategies to minimize the intrusion of well fluids. One technique is through the use of one or more labyrinth chambers to slow the potential intrusion of well fluids into areas of the ESP system 102 that would be damaged by the fluids. A labyrinth chamber may comprise a series of narrow channels and/or tubes that elongate a path of travel of the fluid before coming into contact with critical components of the ESP system 102. The channels and/or tubes may be designed to provide a tortuous path so that the fluids would have to change direction a number of times, causing increased turbulence, hydrostatic resistance, and decreasing the flow rate of the fluids. This serves to increase the time before the fluids intrude on the critical components of the ESP system 102.

Expandable bags (or metal bellows) are another mechanism that may be employed in the seal unit 140 to reduce the likelihood of intrusion of well fluids into an ESP system 102. An expandable bag constructed of a durable, flexible material such as rubber or elastomeric polymer may be disposed inside an empty chamber in the seal unit 140 to create a movable barrier that physically separates dielectric oil that is closer to the motor 138 from oil that is closer to the top of the seal unit 140 where wellbore fluids may enter from wellbore 112. In operation of the ESP system 102, the expandable bag expands to provide additional volume for the heated dielectric oil. If the oil expands sufficiently, it may escape the expandable bag via a check valve, which is included as a safety feature to prevent the expandable bag from rupturing. Once dielectric oil has escaped the expandable bag, it may cause a range of problems including limiting the degree to which the expandable bag may expand in the future or escaping the chamber that contains the bag. Well fluid incursion into a damaged bag enables fluid transfer further into seal unit 140 until the fluids potentially cause damage to components in other parts of the ESP system 102.

When the ESP system 102 is not in operation, the expandable bag or bellows contracts as the dielectric oil cools and contracts to its at-rest volume. Repeated cycles of expansion and contraction combined with the chemical makeup of wellbore fluids and/or wear and tear caused by solids entrained in the wellbore fluids may cause the bag or bellows to fail by cracking or rupturing, resulting in the intrusion of wellbore fluids into critical components of the ESP system 102.

Care must be taken in selecting the material for an expandable bag or bellows to mitigate the potential for degradation of the expandable bag or bellows caused by the wellbore fluids and/or entrained solids, leading to intrusion of fluids into critical system components. Expandable bags and bellows are suitable for use in horizontal wells because their operation does not depend on gravity.

The seal unit 140 may employ one or more labyrinth chambers in conjunction with one or more expandable bags, depending on the operational conditions of a specific ESP system 102. For example, labyrinth chambers may exploit the forces of gravity to operate more effectively. Thus, labyrinth chambers are more effective in ESP systems 102 that are disposed in vertical wells, compared to horizontal wells. Further, labyrinth chambers and expandable bags may be used in series configurations or parallel configurations, depending on the particular implementation needed for the ESP system 102 in hydrocarbon well 100. One example of a factor that may affect the design of the seal unit 140 is the size of the motor 138 of the ESP system 102. The design of a specific configuration of labyrinth chambers and expandable bags in the seal unit 140 is within the ability of one of ordinary skill in the art.

FIGS. 2A-2F are a series of cutaway drawings showing internal components of a seal unit of a typical ESP system as it progresses through a series of operations. The drawings shown in FIGS. 2A-2F show the operation of a seal unit 140 equipped with labyrinth chambers (not expandable bags) for illustrative purposes.

Figures 2A, 2B, 2C, 2D, 2E, 2F:
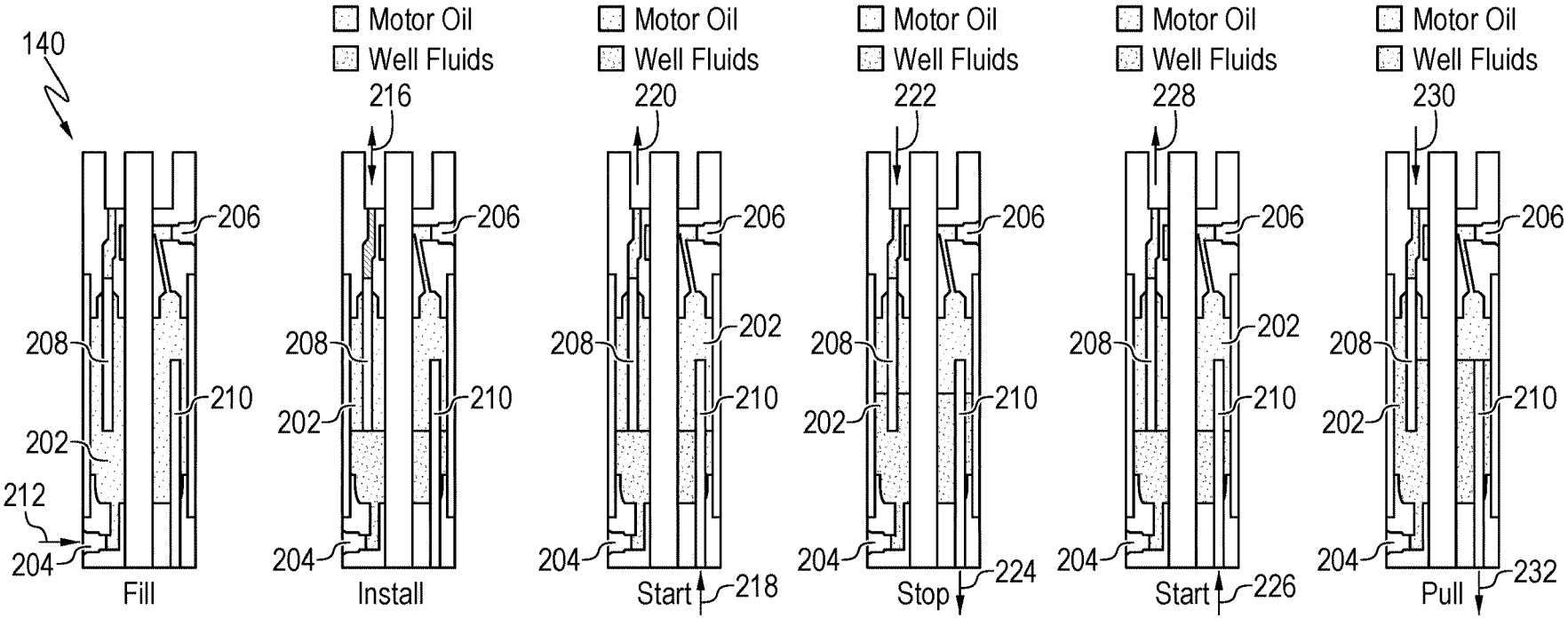
FIGS. 2A-2F are a series of cutaway drawings showing internal components of a seal unit of a typical ESP system as it progresses through a series of operations.

FIG. 2A shows a cutaway view of a seal unit 140 as the seal unit is initially filed with dielectric oil. The level of dielectric oil is indicated by the hatching shown in the legend for FIGS. 2A-2F.

The seal unit 140 includes oil fill/drain valves 204, 206 which may be used to add dielectric oil into a labyrinth chamber 202. In FIG. 2A, dielectric oil is delivered into the labyrinth chamber 202 via the oil fill/drain valve 204, as indicated by arrow 212.

The seal unit 140 includes seal tubes 208 and 210. The seal tubes 208 and 210 channel the flow of dielectric oil and well fluids to adjacent chambers (not shown) as the seal unit 140 is subjected to temperature variations during normal operation. As explained herein, the adjacent chambers may be disposed above or below the area of the seal unit 140 shown in FIGS. 2A-2F. Over time, the operation of the seal unit 140 may result in incursion of wellbore fluids into all of the chambers of the seal unit 140 and further into critical components of the ESP system 102 of which the seal unit 140 is a part.

FIG. 2B shows a cutaway view of the seal unit 140 as the ESP system 102 (FIG. 1) that contains the seal unit 140 is initially installed in a wellbore such as the wellbore 112 (FIG. 1). Wellbore fluids act to equalize pressure with the seal unit 140 at the top of the seal unit 140. By way of example, as the ESP system 102 is placed in the wellbore 112, the seal unit 140 may experience an increase in pressure. This pressure could potentially cause exchange of dielectric oil and external well fluids in the labyrinth chamber 202 via the seal tube 208. If the pressure during installation is sufficient, some amount of the dielectric oil contained within the labyrinth chamber 202 may be dispersed out of the seal unit 140 and into the wellbore 112 (and vice versa) from a seal fluid equalization port, as shown by the arrow 216. As will be explained, excess oil may also be discharged into the wellbore 112 via the seal fluid equalization port when the seal unit 140 is subjected heating and cooling cycles.

FIG. 2C shows a cutaway view of the seal unit 140 as the motor 138 (FIG. 1) begins to operate the pump 110 (FIG. 1) of the ESP system 102 (FIG. 1) of which the seal unit 140 is a component. As the motor 138 continues to run, the ensuing increase in temperature may cause the oil in the labyrinth chamber 202 to expand. This expansion could result in the incursion of dielectric oil into the seal tube 210 from an adjacent chamber, as indicated by arrow 218. The expansion of oil in the labyrinth chamber 202 may further result in some of the dielectric oil contained within the labyrinth chamber 202 being expelled into the wellbore 112 via the seal fluid equalization port, as indicated by arrow 220.

FIG. 2D shows a cutaway view of the seal unit 140 after the motor 138 (FIG. 1) has been stopped for some period of time. As the seal unit 140 cools down after operation of the motor 138, the labyrinth chamber 202 may undergo cooling, resulting in contraction of the dielectric oil. This contraction may cause the incursion of external well fluids from the wellbore 112 into the labyrinth chamber 202 via the seal fluid equalization port, as indicated by the arrow 222.

Contraction of fluid into an adjacent chamber via the seal tube 210 is indicated by the arrow 224 in FIG. 2D. Over time and many cycles of expansion and contraction, the labyrinth chamber 202 may receive more and more wellbore fluid, including entrained solids, which could make it even more difficult for the labyrinth chamber 202 to function properly.

FIG. 2E shows a cutaway view of the seal unit 140 after the motor 138 (FIG. 1) is restarted after having been stopped for some period of time. As the motor 138 is restarted and continues to run, the ensuing increase in temperature may cause the oil in the labyrinth chamber 202 to be expanded again, as discussed above with FIG. 2C. This expansion could result in the incursion of additional dielectric oil into the seal tube 210 from an adjacent chamber, as indicated by arrow 226. The expansion of oil within the labyrinth chamber 202 may result in additional dielectric oil contained within the labyrinth chamber 202 being expelled into the wellbore 112 via the seal fluid equalization port, as indicated by arrow 228.

FIG. 2F shows a cutaway view of the seal unit 140 as the ESP system 102 is removed from the wellbore 112. By way of example, the ESP system 102 could be removed from the wellbore 112 for performance of maintenance operations not related to the seal unit 140. The removal of the ESP system 102 may decrease pressure within the wellbore 112, including on the seal unit 140. This decreased pressure could potentially cause an exchange of well fluids into the labyrinth chamber 202 via the seal tube 208. The incursion of well fluids into the seal fluid equalization port is shown by the arrow 230.

As the motor 138 is repeatedly started (FIGS. 2C, 2E) and stopped (FIG. 2D), the ensuing expansion and contraction of dielectric oil in the labyrinth chamber 202 may increase the likelihood of catastrophic failure of the ESP system 102, such as the shorting out of the motor 138. If this failure occurs, a costly repair operation would then be needed. The repair operation would include removal of the entire ESP system 102 with a rig to replace the seal unit 140 and/or other components. Accordingly, exemplary embodiments of the present techniques desirably extend the life of the seal unit 140 and other components, thereby reducing the lifetime maintenance costs of the ESP system 102.

Figure 3:
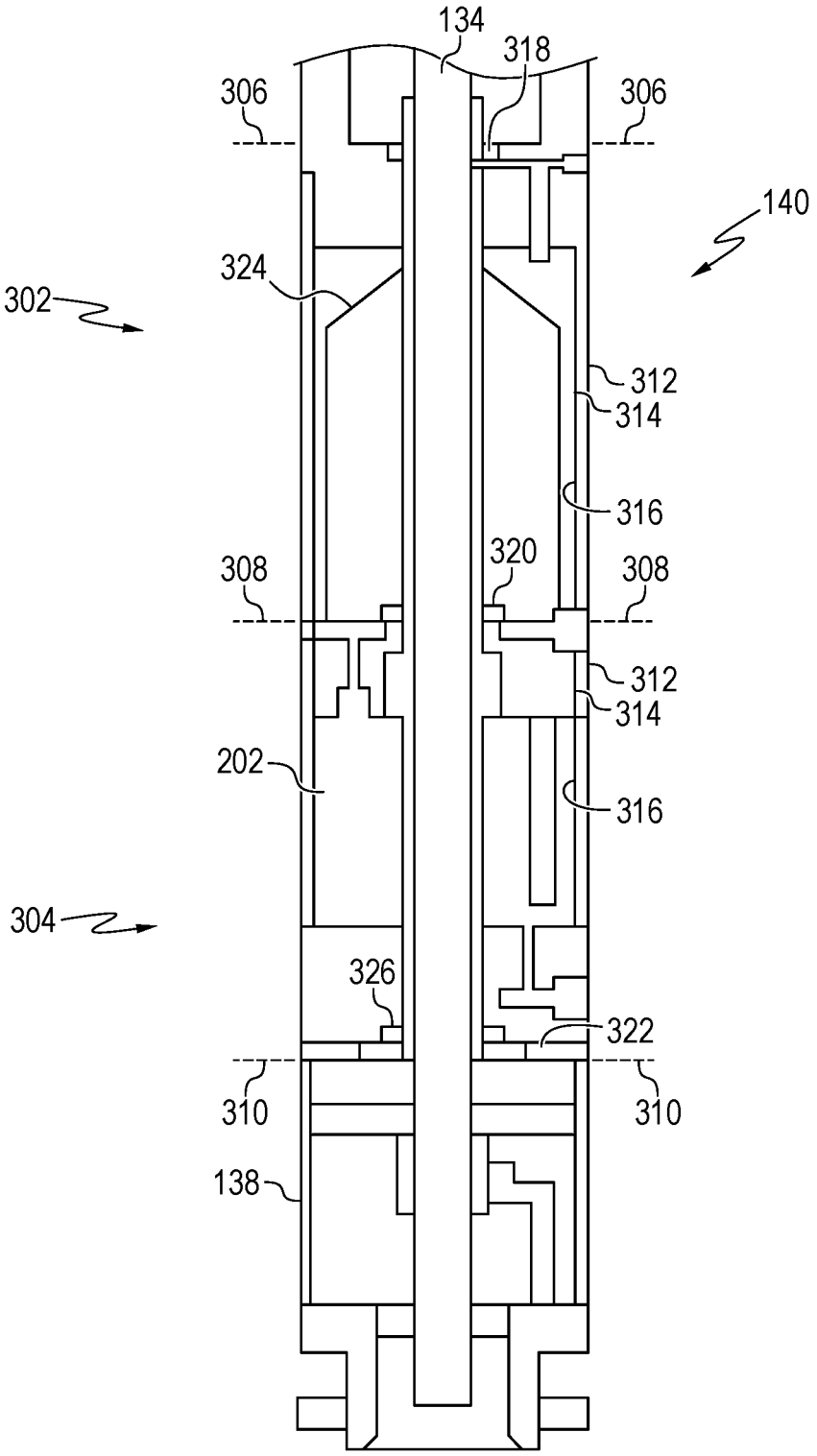
FIG. 3 is a cutaway drawing showing a seal unit of an ESP system in accordance with an exemplary embodiment of the present techniques.

FIG. 3 is a cutaway drawing showing a portion of the seal unit 140 of an ESP system 102 (FIG. 1) in accordance with an exemplary embodiment of the present techniques. FIG. 3 is generally referred to by the reference number 300. The seal unit 140 is enclosed in an insulated housing having double-wall construction. The seal unit 140 shown in FIG. 3 includes both an expandable bag section 302 and a labyrinth chamber section 304 as explained herein. The seal unit 140 extends between a dashed line 306 and a dashed line 310. The expandable bag section 302 is shown between the dashed line 306 and a dashed line 308. The labyrinth chamber section 304 is shown between the dashed line 308 and the dashed line 310.

The expandable bag section 302 is separated on the top from the pump intake 142 by a mechanical seal 318. The expandable bag section 302 is separated on the bottom from the labyrinth chamber section 304 by a mechanical seal 320. The labyrinth chamber section 304 is separated on the bottom from the motor 138 with another mechanical seal 326. An expandable bag (or metal bellows) 324 is disposed within the expandable bag section 302 to physically separate dielectric oil that is closer to the motor 138 from oil that is closer to the top of the seal unit 140 where wellbore fluids can enter the seal unit 140 from wellbore 112, as explained herein.

The housing of the seal unit 140 includes an outer wall 312 and an inner wall 314. A space 316 between the outer wall 312 and the inner wall 314 may be a vacuum, which serves to act as an insulator. Alternatively, the space 316 may be entirely or partially filled with other suitable insulating material.

The double-walled construction of the seal unit 140 may serve to increase the reliability and life of the seal unit 140 by limiting the expansion/contraction cycles of the dielectric oil contained therein. Moreover, the double-walled tubing provided by the outer wall 312 and the inner wall 314 may reduce heat losses (and resulting flow assurance issues) from produced fluids in production tubulars during shutdown of the ESP system 102.

In operation, the double-walled construction of the seal unit 140 could cause the dielectric oil contained therein to maintain the expanded state for an extended period of time after shutdown of operation of the ESP system 102. By preventing contraction of the dielectric oil following operation of the ESP system 102, the amount of dielectric oil escaping into the wellbore, as explained above with reference to FIGS. 2A-2F, would be reduced.

The use of the double-walled construction of the seal unit 140 shown in FIG. 3 could have the effect that the ESP system 102 could return to operation after several hours of downtime without any fluid exchange between the seal unit 140 and the wellbore 112.

In an exemplary embodiment of the present techniques, a thrust bearing 322 is disposed at the bottom of the seal section 140. The thrust bearing 322 is a rotating assembly that handles either some or all of the thrust generated by the pump 110 downstream of the seal unit 140. Friction in the area around the thrust bearing 322 creates heat that needs to be removed by external flow of pumped fluids for proper operation. For this reason, the thrust bearing 322 may be left uninsulated to enhance cooling from produced wellbore fluids. However, this would only account for a small fraction of the surface area of the bottom of the seal unit 140.

Another area of the ESP system 102 that could potentially benefit from insulation is the pump 110 (FIG. 1). Many flow assurance issues (high viscosity, wax, scaling, asphaltenes, etc.) can be triggered or exacerbated by cooling of the ESP system 102 when it ceases operation. Insulation that maintains heat in the produced fluids may reduce these issues during shutdown of the ESP system 102.

Figure 4:
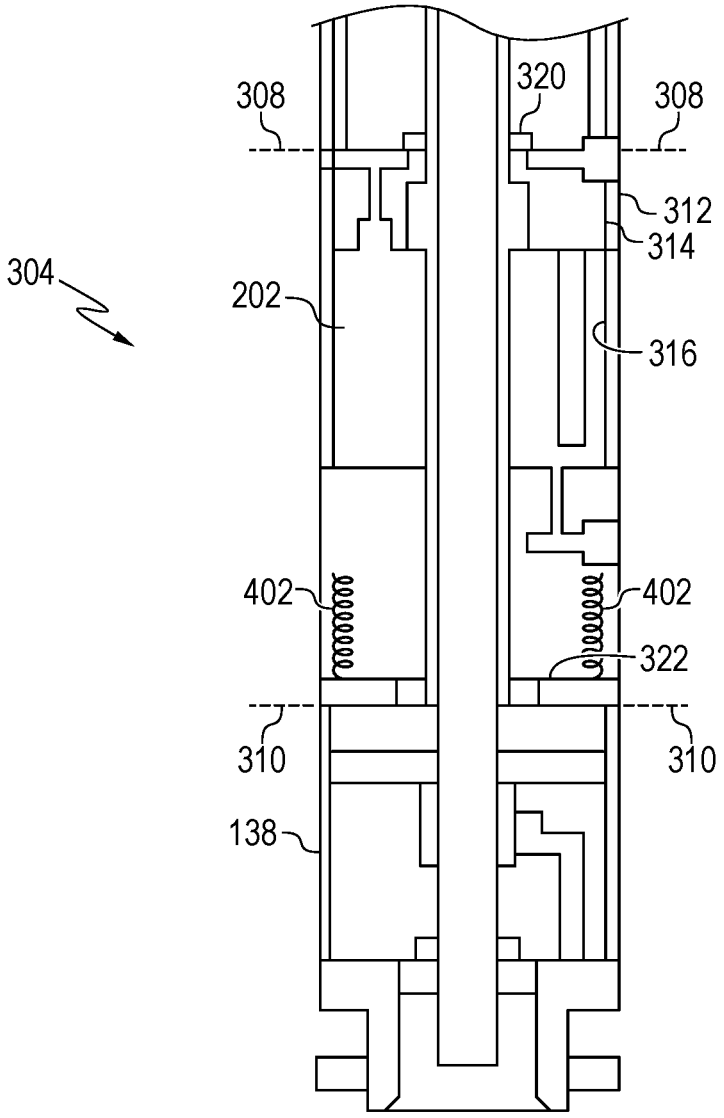
FIG. 4 is a cutaway drawing showing a portion of a seal unit of an ESP system in accordance with an alternative exemplary embodiment of the present techniques.

FIG. 4 is a cutaway drawing showing a portion of the seal unit 140 of an ESP system 102 (FIG. 1) in accordance with an alternative exemplary embodiment of the present techniques. More particularly, FIG. 4 shows an alternative embodiment of the labyrinth chamber section 304 of FIG. 3. Those of ordinary skill in the art will appreciate that the present techniques could also be employed using an expandable bag section 302 shown in FIG. 3. FIG. 4 is generally referred to by the reference number 400.

In the exemplary embodiment of the seal unit 140 shown in FIG. 4, the housing of the labyrinth chamber section 304 is fitted with a heating coil 402. The heating coil 402 may maintain temperature in the labyrinth chamber section 304 when the ESP system 102 is shut down between periods of normal operation. In this manner, the exchange of dielectric oil and well fluids caused by heating and cooling of the components of the ESP system 102, as explained herein with reference to FIGS. 2A-2F, could be reduced or minimized. A relatively small amount of the power could be provided to the heating coil 402 from the motor 138 at a connection between the motor 138 and the labyrinth chamber section 304.

In an exemplary embodiment, one or more temperature sensors could be added to the labyrinth chamber section 304. The sensor(s) could provide temperature information that could be used by a heating coil 402 on/off control loop to maintain the temperature of the dielectric oil upon a shutdown of the ESP system 102. In this manner, it could be possible to maintain a desired temperature or temperature range within the labyrinth chamber section 304 while the ESP system 102 is not operating. A small amount of power would need to flow through the ESP system 102, which could be maintained using surface controls.

In another exemplary embodiment of the present techniques, a heating coil such as the heating coil 402 may be employed with a double-walled seal unit 140, as shown herein in FIG. 3. This combination could improve performance with respect to maintaining temperature inside the seal unit 140. Further, the double-walled seal unit 140 could act as a backup solution or secondary protection in case failure of the heating coil 402 or loss of power from the surface 114.

Figure 5:
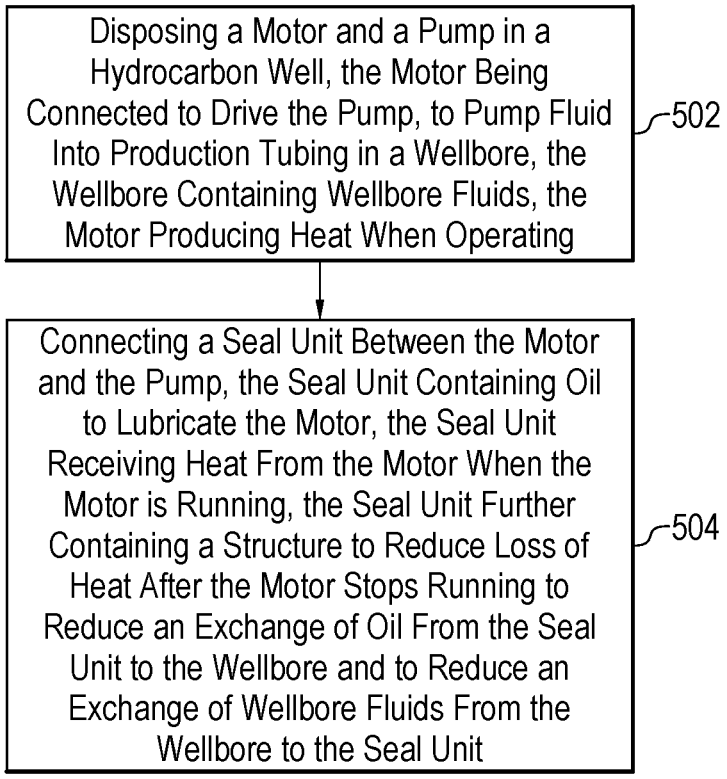
FIG. 5 is a process flow diagram of a method for operating a seal unit of an ESP system in accordance with the present techniques.

FIG. 5 is a process flow diagram of a method for operating an ESP system in a hydrocarbon producing well, in accordance with the present techniques. The method shown in FIG. 5 is generally referred to by the reference number 500.

The method 500 begins at block 502, at which point a motor 138 and a pump 110 are disposed in the hydrocarbon well 100. The motor 138 is connected to drive the pump 110, as explained herein. The pump 110 pumps fluid into the production tubing 130 in the wellbore 112. The motor 138 produces heat when it operates the pump 110.

At block 504, a seal unit 140 is connected between the motor 138 and the pump 110. The seal unit 140 contains dielectric oil, which acts to lubricate the motor 138. As explained herein with respect to FIGS. 2A-2F, the wellbore 112 contains wellbore fluids, which may potentially be exchanged between the seal unit 140 and the wellbore 112. The seal unit 140 receives heat from the motor 138 when the motor is running. As described herein with respect to FIG. 3 and FIG. 4, the seal unit 140 contains a structure to reduce loss of heat after the motor 138 stops running in order to reduce an exchange of oil from the seal unit 140 to the wellbore 112 and to reduce an exchange of wellbore fluids from the wellbore 112 to the seal unit 140.

The structure of the seal unit 140 may include a double-walled housing. The housing may have a first wall and a second wall that have an insulating material disposed therebetween. The structure of the seal unit 140 may include a heating coil 402.

The process flow diagram of FIG. 5 is not intended to indicate that the steps of the method 500 are to be executed in any particular order, other than where indicated specifically, or that all of the steps of the method 500 are to be included in every case. Further, any number of additional steps not shown in FIG. 5 may be included within the method 500, depending on the details of the specific implementation needed for the ESP system 102 installed in wellbore 112.

In one or more embodiments, the present techniques may be susceptible to various modifications and alternative forms, such as the following embodiments as noted in paragraphs 1 to 27:

1. An electric submersible pump (ESP) system, comprising: a pump; a motor connected to drive the pump, the pump and motor being disposed to pump fluid into production tubing in a wellbore, the wellbore containing wellbore fluids, the motor producing heat when operating; a seal unit connected between the motor and the pump, the seal unit containing oil to lubricate the motor, the seal unit receiving heat from the motor when the motor is running, the seal unit further containing a structure to reduce loss of heat after the motor stops running to reduce an exchange of oil from the seal unit to the wellbore and to reduce an exchange of wellbore fluids from the wellbore to the seal unit.
2. The ESP system of paragraph 1, comprising an expandable bag or metal bellows section disposed in the seal unit, the expandable bag section containing an expandable bag or metal bellows that holds the oil, the oil expanding when the seal unit receives heat from the motor when the motor is running, the structure reducing a speed of contraction of the oil after the motor stops running.
3. The ESP system of paragraphs 1 or 2, comprising a labyrinth chamber disposed within the seal unit to hold the oil, the labyrinth chamber providing a tortuous path in which the oil flows when the seal unit receives heat from the motor when the motor is running, the structure reducing a speed of fluid flow through the tortuous path of the labyrinth chamber after the motor stops running.
4. The ESP system of any of paragraphs 1 to 3, comprising a labyrinth chamber disposed within the seal unit to hold the oil, the labyrinth chamber providing a tortuous path in which the oil flows when the seal unit receives heat from the motor when the motor is running, the structure reducing a speed of fluid flow through the tortuous path of the labyrinth chamber after the motor stops running.
5. The ESP system of any of paragraphs 1 to 4, wherein the structure comprises a double-walled housing disposed around the seal unit.
6. The ESP system of any of paragraphs 1 to 5, wherein a first wall and a second wall of the double-walled housing are separated by an insulating material.
7. The ESP system of any of paragraphs 1 to 6, wherein the structure comprises a heating coil disposed within the seal unit.
8. The ESP system of any of paragraphs 1 to 7, wherein the heating coil is powered by the motor.
9. The ESP system of any of paragraphs 1 to 8 wherein the structure comprises: a double-walled housing disposed around the seal unit; and a heating coil disposed within the seal unit.
10. A method of operating an electric submersible pump (ESP) system, the method comprising: disposing a motor and a pump, the motor being connected to drive the pump, to pump fluid into production tubing in a wellbore, the wellbore containing wellbore fluids, the motor producing heat when operating; and connecting a seal unit between the motor and the pump, the seal unit containing oil to lubricate the motor, the seal unit receiving heat from the motor when the motor is running, the seal unit further containing a structure to reduce loss of heat after the motor stops running to reduce an exchange of oil from the seal unit to the wellbore and to reduce an exchange of wellbore fluids from the wellbore to the seal unit.

11. The method of paragraph 10, wherein the seal unit includes an expandable bag section disposed in the seal unit, the expandable bag section containing an expandable bag or metal bellows that holds the oil, the oil expanding when the seal unit receives heat from the motor when the motor is running, the structure reducing a speed of contraction of the oil after the motor stops running.

12. The method of paragraphs 10 or 11, wherein the seal unit includes a labyrinth chamber disposed within the seal unit to hold the oil, the labyrinth chamber providing a tortuous path in which the oil flows when the seal unit receives heat from the motor when the motor is running, the structure reducing a speed of fluid flow through the tortuous path of the labyrinth chamber after the motor stops running.

13. The method of any of paragraphs 10 to 12, wherein the seal unit includes a labyrinth chamber disposed within the seal unit to hold the oil, the labyrinth chamber providing a tortuous path in which the oil flows when the seal unit receives heat from the motor when the motor is running, the structure reducing a speed of fluid flow through the tortuous path of the labyrinth chamber after the motor stops running.

14. The method of any of paragraphs 10 to 13, wherein the structure comprises a double-walled housing disposed around the seal unit.

15. The method of any of paragraphs 10 to 14, wherein a first wall and a second wall of the double-walled housing are separated by an insulating material.

16. The method of any of paragraphs 10 to 15, wherein the structure comprises a heating coil disposed within the seal unit.

17. The method of any of paragraphs 10 to 16, wherein the heating coil is powered by the motor.

18. The method of any of paragraphs 10 to 17 wherein the structure comprises: a double-walled housing disposed around the seal unit; and a heating coil disposed within the seal unit.

19. A well, comprising: an electric submersible pump (ESP) system, that includes a pump and a motor connected to drive the pump, the pump and motor being disposed to pump fluid into production tubing in a wellbore, the wellbore containing wellbore fluids, the motor producing heat when operating; a seal unit connected between the motor and the pump, the seal unit containing oil to lubricate the motor, the seal unit receiving heat from the motor when the motor is running, the seal unit further containing a structure to reduce loss of heat after the motor stops running to reduce an exchange of oil from the seal unit to the wellbore and to reduce an exchange of wellbore fluids from the wellbore to the seal unit.

20. The well of paragraph 19, comprising an expandable bag section disposed in the seal unit, the expandable bag section containing an expandable bag or metal bellows that holds the oil, the oil expanding when the seal unit receives heat from the motor when the motor is running, the structure reducing a speed of contraction of the oil after the motor stops running.

21. The well of paragraphs 19 or 20, comprising a labyrinth chamber disposed within the seal unit to hold the oil, the labyrinth chamber providing a tortuous path in which the oil flows when the seal unit receives heat from the motor when the motor is running, the structure reducing a speed of fluid flow through the tortuous path of the labyrinth chamber after the motor stops running.

22. The well of any of paragraphs 19 to 21, comprising a labyrinth chamber disposed within the seal unit to hold the oil, the labyrinth chamber providing a tortuous path in which the oil flows when the seal unit receives heat from the motor when the motor is running, the structure reducing a speed of fluid flow through the tortuous path of the labyrinth chamber after the motor stops running.

23. The well of any of paragraphs 19 to 22, wherein the structure comprises a double-walled housing disposed around the seal unit.

24. The well of any of paragraphs 19 to 23, wherein a first wall and a second wall of the double-walled housing are separated by an insulating material.

25. The well of any of paragraphs 19 to 24, wherein the structure comprises a heating coil disposed within the seal unit.

26. The well of any of paragraphs 19 to 25, wherein the heating coil is powered by the motor.

27. The well of any of paragraphs 19 to 26, wherein the structure comprises: a double-walled housing disposed around the seal unit; and a heating coil disposed within the seal unit.

While the embodiments described herein are well-calculated to achieve the advantages set forth, it will be appreciated that the embodiments described herein are susceptible to modification, variation, and change without departing from the spirit thereof. Indeed, the present techniques include all alternatives, modifications, and equivalents falling within the true spirit and scope of the appended claims.

What is claimed is:

1. An electric submersible pump (ESP) system, comprising:

a pump;

a motor connected to drive the pump, the pump and motor being disposed to pump fluid into production tubing in a wellbore, the wellbore containing wellbore fluids, the motor producing heat when operating;

a seal unit connected between the motor and the pump, the seal unit containing oil to lubricate the motor, the seal unit receiving heat from the motor when the motor is running, the seal unit further containing a structure to reduce loss of heat after the motor stops running to reduce an exchange of oil from the seal unit to the wellbore and to reduce an exchange of wellbore fluids from the wellbore to the seal unit.

2. The ESP system of claim 1, comprising an expandable bag or metal bellows section disposed in the seal unit, the expandable bag section containing an expandable bag or metal bellows that holds the oil, the oil expanding when the seal unit receives heat from the motor when the motor is running, the structure reducing a speed of contraction of the oil after the motor stops running.

3. The ESP system of claim 2, comprising a labyrinth chamber disposed within the seal unit to hold the oil, the labyrinth chamber providing a tortuous path in which the oil flows when the seal unit receives heat from the motor when the motor is running, the structure reducing a speed of fluid flow through the tortuous path of the labyrinth chamber after the motor stops running.

4. The ESP system of claim 1, comprising a labyrinth chamber disposed within the seal unit to hold the oil, the labyrinth chamber providing a tortuous path in which the oil flows when the seal unit receives heat from the motor when the motor is running, the structure reducing a speed of fluid flow through the tortuous path of the labyrinth chamber after the motor stops running.

5. The ESP system of claim 1, wherein the structure comprises a double-walled housing disposed around the seal unit.

6. The ESP system of claim 5, wherein a first wall and a second wall of the double-walled housing are separated by an insulating material.

7. The ESP system of claim 1, wherein the structure comprises a heating coil disposed within the seal unit.

8. The ESP system of claim 7, wherein the heating coil is powered by the motor.

9. The ESP system of claim 1 wherein the structure comprises:

a double-walled housing disposed around the seal unit; and a heating coil disposed within the seal unit.

10. A method of operating an electric submersible pump (ESP) system, the method comprising:

disposing a motor and a pump, the motor being connected to drive the pump, to pump fluid into production tubing in a wellbore, the wellbore containing wellbore fluids, the motor producing heat when operating; and connecting a seal unit between the motor and the pump, the seal unit containing oil to lubricate the motor, the seal unit receiving heat from the motor when the motor is running, the seal unit further containing a structure to reduce loss of heat after the motor stops running to reduce an exchange of oil from the seal unit to the wellbore and to reduce an exchange of wellbore fluids from the wellbore to the seal unit.

11. The method of claim 10, wherein the seal unit includes an expandable bag section disposed in the seal unit, the expandable bag section containing an expandable bag or metal bellows that holds the oil, the oil expanding when the seal unit receives heat from the motor when the motor is running, the structure reducing a speed of contraction of the oil after the motor stops running.

12. The method of claim 11, wherein the seal unit includes a labyrinth chamber disposed within the seal unit to hold the oil, the labyrinth chamber providing a tortuous path in which the oil flows when the seal unit receives heat from the motor when the motor is running, the structure reducing a speed of fluid flow through the tortuous path of the labyrinth chamber after the motor stops running.

13. The method of claim 10, wherein the seal unit includes a labyrinth chamber disposed within the seal unit to hold the oil, the labyrinth chamber providing a tortuous path in which the oil flows when the seal unit receives heat from the motor when the motor is running, the structure reducing a speed of fluid flow through the tortuous path of the labyrinth chamber after the motor stops running.

14. The method of claim 10, wherein the structure comprises a double-walled housing disposed around the seal unit.

15. The method of claim 14, wherein a first wall and a second wall of the double-walled housing are separated by an insulating material.

16. The method of claim 10, wherein the structure comprises a heating coil disposed within the seal unit.

17. The method of claim 16, wherein the heating coil is powered by the motor.

18. The method of claim 10 wherein the structure comprises:

a double-walled housing disposed around the seal unit; and a heating coil disposed within the seal unit.

19. A well, comprising:

an electric submersible pump (ESP) system, that includes a pump and a motor connected to drive the pump, the pump and motor being disposed to pump fluid into production tubing in a wellbore, the wellbore containing wellbore fluids, the motor producing heat when operating;

a seal unit connected between the motor and the pump, the seal unit containing oil to lubricate the motor, the seal unit receiving heat from the motor when the motor is running, the seal unit further containing a structure to reduce loss of heat after the motor stops running to reduce an exchange of oil from the seal unit to the wellbore and to reduce an exchange of wellbore fluids from the wellbore to the seal unit.

20. The well of claim 19, comprising an expandable bag section disposed in the seal unit, the expandable bag section containing an expandable bag or metal bellows that holds the oil, the oil expanding when the seal unit receives heat from the motor when the motor is running, the structure reducing a speed of contraction of the oil after the motor stops running.

21. The well of claim 20, comprising a labyrinth chamber disposed within the seal unit to hold the oil, the labyrinth chamber providing a tortuous path in which the oil flows when the seal unit receives heat from the motor when the motor is running, the structure reducing a speed of fluid flow through the tortuous path of the labyrinth chamber after the motor stops running.

22. The well of claim 19, comprising a labyrinth chamber disposed within the seal unit to hold the oil, the labyrinth chamber providing a tortuous path in which the oil flows when the seal unit receives heat from the motor when the motor is running, the structure reducing a speed of fluid flow through the tortuous path of the labyrinth chamber after the motor stops running.

23. The well of claim 19, wherein the structure comprises a double-walled housing disposed around the seal unit.

24. The well of claim 23, wherein a first wall and a second wall of the double-walled housing are separated by an insulating material.

25. The well of claim 19, wherein the structure comprises a heating coil disposed within the seal unit.

* * * * *